US007386095B2

(12) United States Patent
Okada et al.

(10) Patent No.: US 7,386,095 B2
(45) Date of Patent: Jun. 10, 2008

(54) X-RAY TUBE

(75) Inventors: Tomoyuki Okada, Hamamatsu (JP); Toru Fujita, Hamamatsu (JP); Tooru Yamamoto, Hamamatsu (JP); Tatsuya Matsumura, Hamamatsu (JP); Tatsuya Nakamura, Hamamatsu (JP)

(73) Assignee: Hamamatsu Photonics K.K., Hamamatsu-shi (JP)

( * ) Notice: Subject to any disclaimer, the term of this patent is extended or adjusted under 35 U.S.C. 154(b) by 0 days.

(21) Appl. No.: 11/512,416

(22) Filed: Aug. 30, 2006

(65) Prior Publication Data

US 2007/0058782 A1 Mar. 15, 2007

(30) Foreign Application Priority Data

Aug. 31, 2005 (JP) ..... P2005-251141

(51) Int. Cl.
*H01J 35/14* (2006.01)

(52) U.S. Cl. ..... 378/138; 378/187

(58) Field of Classification Search ..... 378/139, 378/137, 121, 142, 138, 119
See application file for complete search history.

(56) References Cited

U.S. PATENT DOCUMENTS 2,952,790 A * 9/1960 Steen ..... 378/139
5,402,464 A * 3/1995 Schenk et al. ..... 378/136

FOREIGN PATENT DOCUMENTS

| | | |
|---|---|---|
| JP | 56-36853 | 4/1981 |
| JP | 5-325853 | 12/1993 |
| JP | 7-14515 | 1/1995 |
| JP | 2004-265602 | 9/2004 |

* cited by examiner

*Primary Examiner*—Hoon Song
(74) *Attorney, Agent, or Firm*—Drinker Biddle & Reath LLP

(57) ABSTRACT

The present invention relates to an X-ray tube with a structure, by which the charging of an insulating member, disposed inside a container, is effectively prevented to enable stable operation to be secured. This X-ray tube has an electron source that emits electrons, a target that generates X-rays in response to the incidence of the electrons, first and second electrons, each having a side face portion that extends along the direction of incidence of the electrons and forming a predetermined electric field between the electron source and the target, and an insulating support member, for supporting the first and second electrodes, being disposed along the side face portions of the first and second electrodes. The second electrode, of the first and second electrodes, is positioned closest to the target and has an anti-charging edge portion that is positioned at an X-ray generating surface end of the side face portion and that extends toward the exterior of the container so as to cover over the support members from the target.

5 Claims, 5 Drawing Sheets

X-RAY TUBE

BACKGROUND OF THE INVENTION

1. Field of the Invention

The present invention relates to an X-ray tube that generates X-rays.

2. Related Background Art

An X-ray tube has a container that houses an electron gun in a space depressurized to a high degree of vacuum, and generates X-rays by making electrons, generated by the electron gun, incident on a target. As such an X-ray tube, for example, a compact X-ray tube described in Patent Document 1, described below, is known. In this X-ray tube, a cylindrical accelerating electrode is mounted on a support plate that is fixed to an inner side of a side face of a glass tube, and an electron gun is disposed at one end and a target is disposed at the other end of the accelerating electrode. X-rays are generated by electrons being emitted from the electron gun and being made incident onto the target upon being accelerated by the accelerating electrode.

Patent Document 1: Japanese Patent Application Laid-Open No. Hei 7-14515

Patent Document 2: Japanese Patent Application Laid-Open No. Hei 5-325853

Patent Document 3: Japanese Patent Application Laid-Open No. 2004-265602

SUMMARY OF THE INVENTION

The present inventors have examined the conventional X-ray tubes, and as a result, have discovered the following problems.

That is, in the conventional compact X-ray tube, such as that described above, since the distance between the target and the electron gun is short, the effects of electrons that are reflected at the target become non-negligible. In other words, the electrons that are reflected toward the electron gun from the target reach a support member that supports a focusing electrode and other electrodes that make up the electron gun and charge the support member. Here, although the support member is composed of an insulating material for maintaining an insulated state among the respective electrodes, when the support member becomes charged, the insulating property cannot be maintained. Consequently, the voltage resistance characteristics between the electrodes fixed on the support member degrade, potential differences that are to be maintained across the respective electrodes cannot be maintained, and the desired electron emission ability and X-ray output become difficult to achieve. In particular, as the length in a tube axis direction is made short to make the X-ray tube more compact, the target and the electron gun approach each other and the effects of reflected electrons thus become significant.

The present invention has been developed to eliminate the problems described above. It is an object of the present invention to provide an X-ray tube with a structure by which the charging of insulating members, disposed inside a container, is effectively prevented to enable stable operation to be secured.

To achieve the above object, an X-ray tube according to the present invention comprises, at least, an electron source, a target, one or more electrodes, and an insulating support member. The electron source is disposed on a predetermined tube axis and emits electrons. The target is positioned on the tube axis and generates X-rays in response to the incidence of the electrons emitted from the electron source. Each of the electrodes has a side face portion that extends along the propagation direction of the electrons propagating from the electron source to the target, and forms a predetermined electric field between the electron source and the target. The support member is disposed along the side face portions of these electrodes and supports the electrodes.

In particular, in the X-ray tube according to the present invention, the endmost electrode disposed closest to the target, of the electrodes, has an anti-charging edge portion that is positioned at a target side end of the side face portion of the endmost electrode and that extends in a direction orthogonal to the tube axis so as to cover over the support member from the target.

In accordance with the X-ray tube having such a structure, although the electrons emitted from the electron source reach the target once, electrons reflected from the target toward the support member are blocked by the edge portion formed on the electrode closest to the target. Charging of the support member by the reflected electrons is thus effectively prevented. In other words, by the edge portion being provided, the voltage resistance characteristics between electrodes in the X-ray tube are maintained.

The edge portion preferably has a shape such that a front end portion thereof, opposing an end portion connected to the side face portion, extends further toward the support members. By this arrangement, the voltage resistance characteristics between the electrode and the target are improved and discharge between the electrode and the target is prevented adequately.

The edge portion preferably has a curved surface that is bent so as to protrude toward the target. In this case, the radius of curvature of the electrode disposed at the target side becomes large, the voltage resistance characteristics between the electrode and the target are improved effectively, and the processing of the electrode is facilitated.

Of the electrodes, the endmost electrode positioned closest to the target preferably includes a focusing electrode that focuses the electrons toward the target. In this case, both efficient incidence of electrons onto the target and prevention of charging of the support member by reflected electrons can be realized at the same time.

The electron source preferably includes a field emission type of electron source. In this case, even when a high voltage is applied across electrodes to draw electrons, the voltage resistance characteristics between electrodes are secured. An X-ray tube having stable X-ray output characteristics can thus be provided.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, embodiments of an X-ray tube according to the present invention will be explained in detail with reference to FIGS. 1 to 4, 5A, and 5B. In the description of the drawings, portions that are the same or are equivalent shall be provided with the same symbol, and redundant description shall be omitted.

Figure 1:
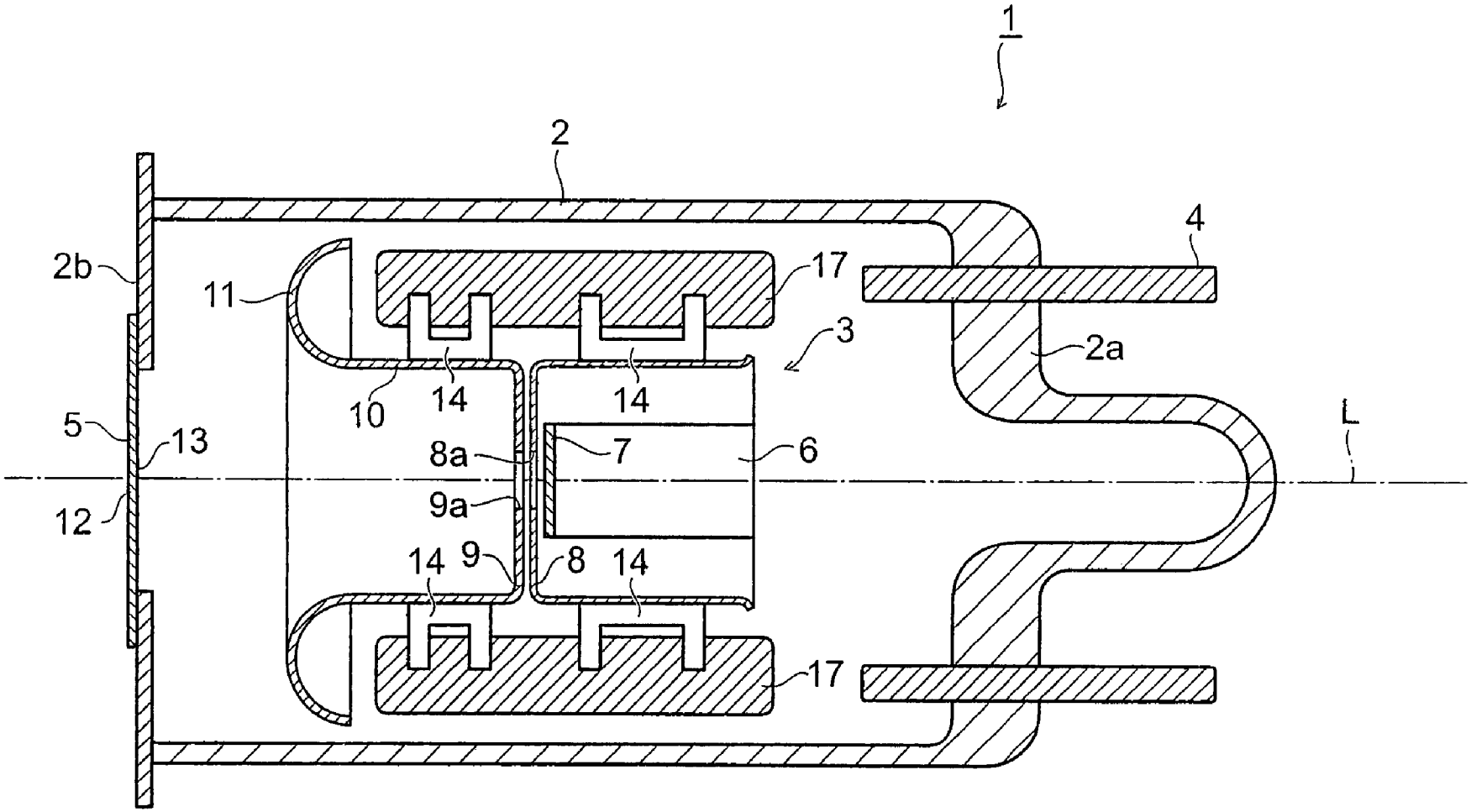
FIG. 1 is a view showing a cross-sectional structure of an embodiment of an X-ray tube according to the present invention.
Figure 2:
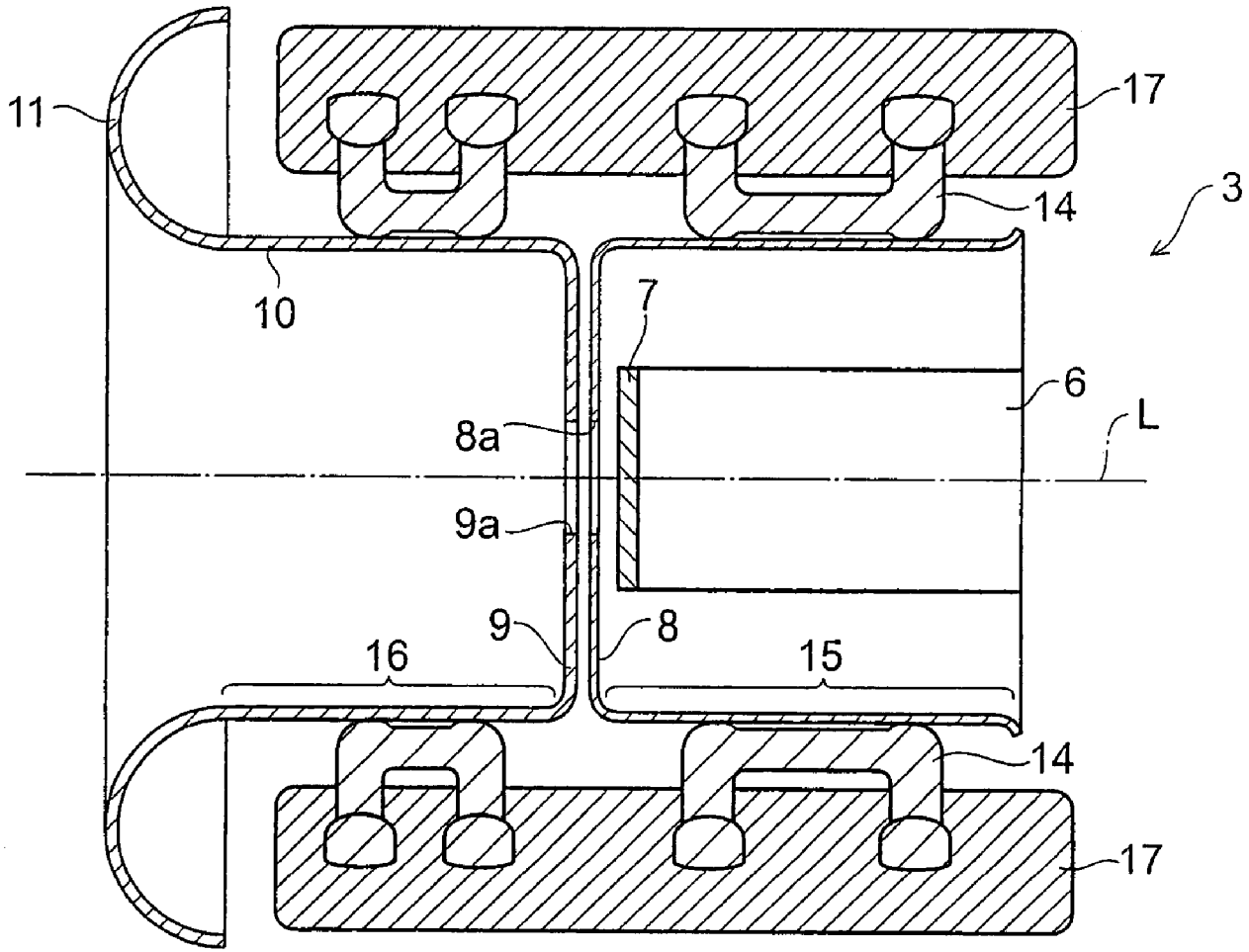
FIG. 2 is an enlarged sectional view of principal portions of the X-ray tube shown in FIG. 1.
Figure 3:
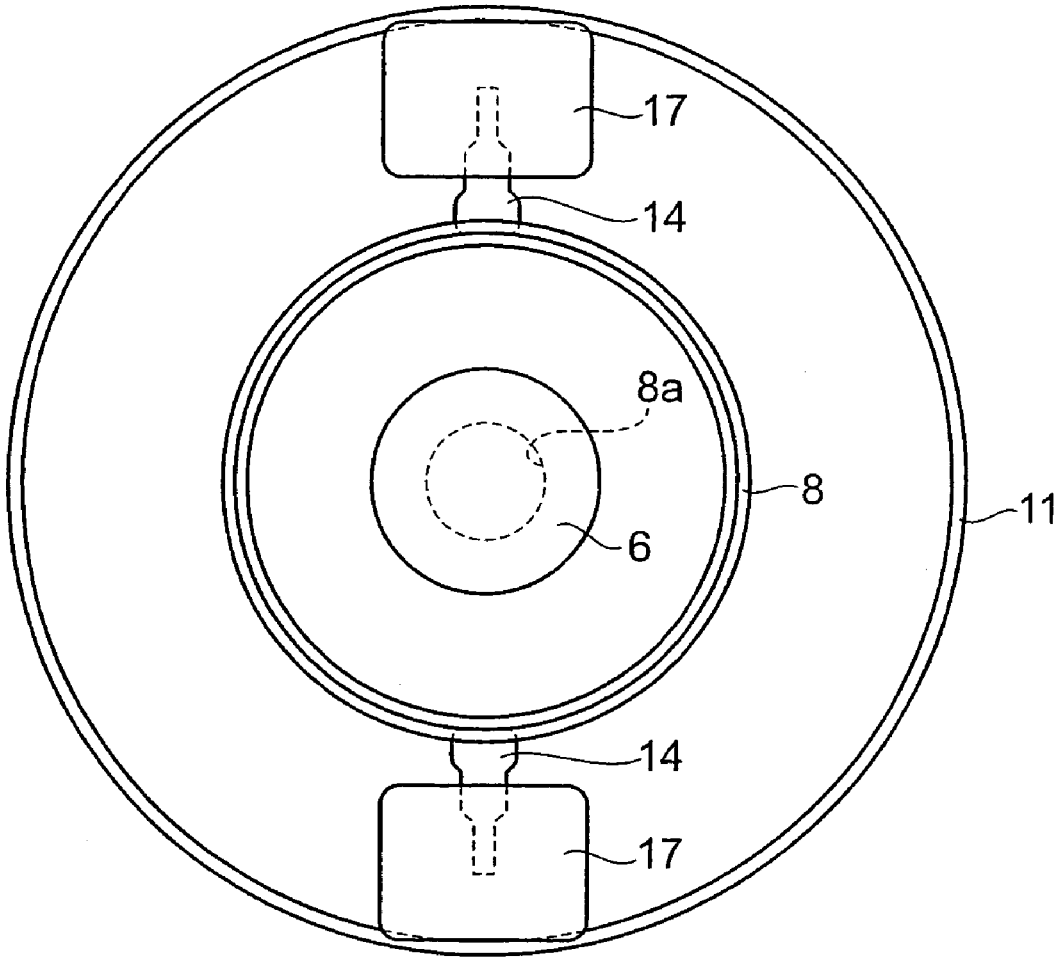
FIG. 3 is a side view of an electron gun portion of the X-ray tube shown in FIG. 1 as viewed from the right side (side opposite a direction of emission of X-rays) of FIG. 1.

FIG. 1 is a view showing a cross-sectional structure of an embodiment of an X-ray tube according to the present invention. FIG. 2 is an enlarged sectional view of principal portions of the X-ray tube 1 shown in FIG. 1. FIG. 3 is a side view of an electron gun portion of the X-ray tube 1 shown in FIG. 1 as viewed from the right side (side opposite a direction of emission of X-rays) of FIG. 1. As shown in FIG. 1, the X-ray tube 1 according to the present embodiment has an airtight container 2, an electron gun portion 3, and an X-ray generating portion 5. The airtight container 2 is composed of glass and has a cylindrical shape, into one end face 2*a* of which is inserted a stem pin 4. The electron gun portion 3 is supported at a predetermined position inside the airtight container 2 and emits electrons. The X-ray generating portion 5 is fixed in close contact with the other end face 2*b* of the airtight container 2 and generates X-rays in response to the incidence of the electrons from the electron gun portion 3.

The electron gun portion 3 has a field emission type of cold cathode (electron source) 6, a first electrode 8, and a second electrode 9. The cold cathode (electron source) 6 is a cylindrical electrode that is positioned so that its central axis lies along a central axial line L of the airtight container 2. Meanwhile, each of the first electrode 8 and the second electrode 9 is also positioned in front of the cold cathode 6 so that its central axis lies along the central axial line L. The cold cathode 6 has an electron emission layer 7, which is disposed at an end face at the X-ray generating portion 5 side and contains carbon nanotubes, and is a so-called field emission type of electron source that can emit electrons to the exterior by the actions of an electrical field formed by the application of a voltage.

The first electrode 8 is a metal electrode of substantially cylindrical shape that has a first opening at the end face 2*a* side of the airtight container 2. Also at a center of the end face of the first electrode 8 at the end face 2*b* side is formed an aperture 8*a*, which is a second opening. In the interior of the first electrode 8, cold cathode 6 is positioned so that the surface of the electron emission layer 7 faces the aperture 8*a*, and the electrons that are emitted toward the X-ray generating portion 5 from the electron emission layer 7 pass through the aperture 8*a*.

The second electrode 9 is a metal electrode, with which a cylindrical portion 10, of substantially cylindrical shape and having a first opening at the end face 2*b* side of the airtight container 2, is integrated with an eave portion (edge portion) 11, formed so as to extend toward outer sides at an open end of the cylindrical portion 10. Here, "outer sides" refers to sides in directions away from the central axial line L and yet inside airtight container 2, that is, the sides that approach the inner wall of the airtight container 2. At a center of the end face of the second electrode 9 which is positioned at the first electrode 8 side, an aperture 9*a* is provided as a second opening with substantially the same shape as aperture 8*a*. The first electrode 8 and the second electrode 9 are positioned in a state of being separated by a predetermined distance along the central axial line L with the respective apertures 8*a* and 9*a* facing each other. The second electrode 9 is disposed at a position closer to a target 13 (the details of which shall be described later) of the X-ray generating portion 5 than the first electrode 8.

By the actions of an electric field formed between the cold cathode 6 and the X-ray generating portion 5 by the first electrode 8 and the second electrode 9 with the above-described structures and the target 13, the respective electrodes are made to function both as drawing electrodes that accelerate the electrons, generated from the cold cathode 6, toward the X-ray generating portion 5 and as focusing electrodes that control the degree of dispersion of (focus) the electrons. That is, the emission of electrons from the cold cathode 6 and the focus of the electrons toward the X-ray generating portion 5 are controlled by a voltage being applied between the first electrode 8 and the second electrode 9.

The X-ray generating portion 5 is arranged from an X-ray extraction window 12, which is a plate member made of beryllium, and the target 13. The target 13 is formed by vapor depositing tungsten onto an inner surface (surface facing the interior of the airtight container 2) of the X-ray extraction window 12. The X-ray tube 1 is a transmission type of X-ray tube, in which the X-rays, generated by the incidence of the electrons emitted from the cold cathode 6 onto the target 13, are extracted to the exterior of the airtight container 2 along the incidence direction of the electrons (that matches the direction of propagation of the electrons that propagate from the cold cathode 6 to the target 13) and via the X-ray extraction window 12. The target 13 is thus positioned to be substantially perpendicular to the central axial line L.

The arrangement of the electron gun portion 3 shall now be described in detail with reference to FIG. 2 and FIG. 3.

The first electrode 8 and the second electrode 9 respectively have side face portions 15 and 16, both having curved surfaces along the central axial line L. At the outer sides of these side face portions 15 and 16, two electrode supports (support members) 17 are disposed along the side face portions 15 and 16 and substantially parallel to the central axial line L, and these electrode supports 17 support the first electrode 8 and the second electrode 9 via U-shaped mounting members 14. These electrode supports 17 are composed of an insulating material having glass as a main component and are shaped to rod-like forms. The electrode supports 17 of such structure are disposed in parallel across the central axial line L inside the airtight container 2. By supporting the first electrode 8 and the second electrode 9 at the side face portions 15 and 16, the electrode supports 17 fix the first electrode 8 and the second electrode 9 in a predetermined positional relationship.

The eave portion 11 (edge portion) is formed at the X-ray generating portion 5 end of the side face portion 6 of the second electrode 9. The cross-sectional shape of the eave portion 11 in a plane containing the central axial line L is a substantially semicircular shape that is curved so as to protrude toward the X-ray generating portion 5. The eave portion 11 thus has a shape, which extends toward the outer sides while curving so as to protrude toward the X-ray generating portion 5 from the X-ray generating portion 5 end of the side face portion 16 and with which a front end portion is gradually bent toward the electrode supports 17. Here, the width of the eave portion 11 in the radial direction of the airtight container 2 is set to an adequate width that enables the end portions of the electrode supports 17 to be covered over when viewed from the X-ray generating portion 5 side as shown in FIG. 3.

In the X-ray tube 1 with the above-described structure, the electrons that are emitted from the electron emission layer 7 of the cold cathode 6 are made incident on the target 13 of the X-ray generating portion 5. Although in this process, X-rays are extracted toward the exterior of the airtight container 2 from the X-ray extraction window 12 of the X-ray generating portion 5, a portion of the incident electrons are reflected toward the electron gun portion 3 from the target 13. Of such reflected electrons, the electrons propagating toward the electrode supports 17 are blocked by the eave portion 11 formed on the second electrode 9 close to the target 13. The charging of the electrode supports 17 by the reflected electrons is thus effectively prevented and the voltage resistance characteristics between the first electrode 8 and the second electrode 9 are maintained. Especially in the X-ray tube 1, since the cold cathode 6 is employed as the electron source, the voltage applied between the first electrode 8 and the second electrode 9 tends to be several kV and thus comparatively high. However, even in such a case, the charging of the electrode supports 17 is restrained and the degradation of the voltage resistance characteristics between the first electrode 8 and the second electrode 9 is prevented adequately.

The above-described anti-charging effect becomes significant with a compact X-ray tube, such as the X-ray tube 1 of the embodiment, in which the ratio of the interval between the electrode and the target with respect to the diameter of the airtight container is comparatively small and the reflected electrons from the target are readily made incident on the support members of the electrodes. This is because, with compact X-ray tubes, the electrode support members are disposed near the target and the effects of charging of the support members by the reflected electrons from the target are prominent.

On the other hand, because the eave portion 11 is curved so as to swell toward the target 13, the radius of curvature of the electrode can be made large. The voltage resistance characteristics between the second electrode 9 and the target 13 are thus improved effectively and the processing of the second electrode 9 is facilitated. Furthermore, because with the eave portion 11, the front end portion extends further toward the electrode supports 17 at the outer sides, the voltage resistance characteristics between the electrode and the target are improved and discharge between the electrode and the target is prevented adequately as well.

Figure 4:
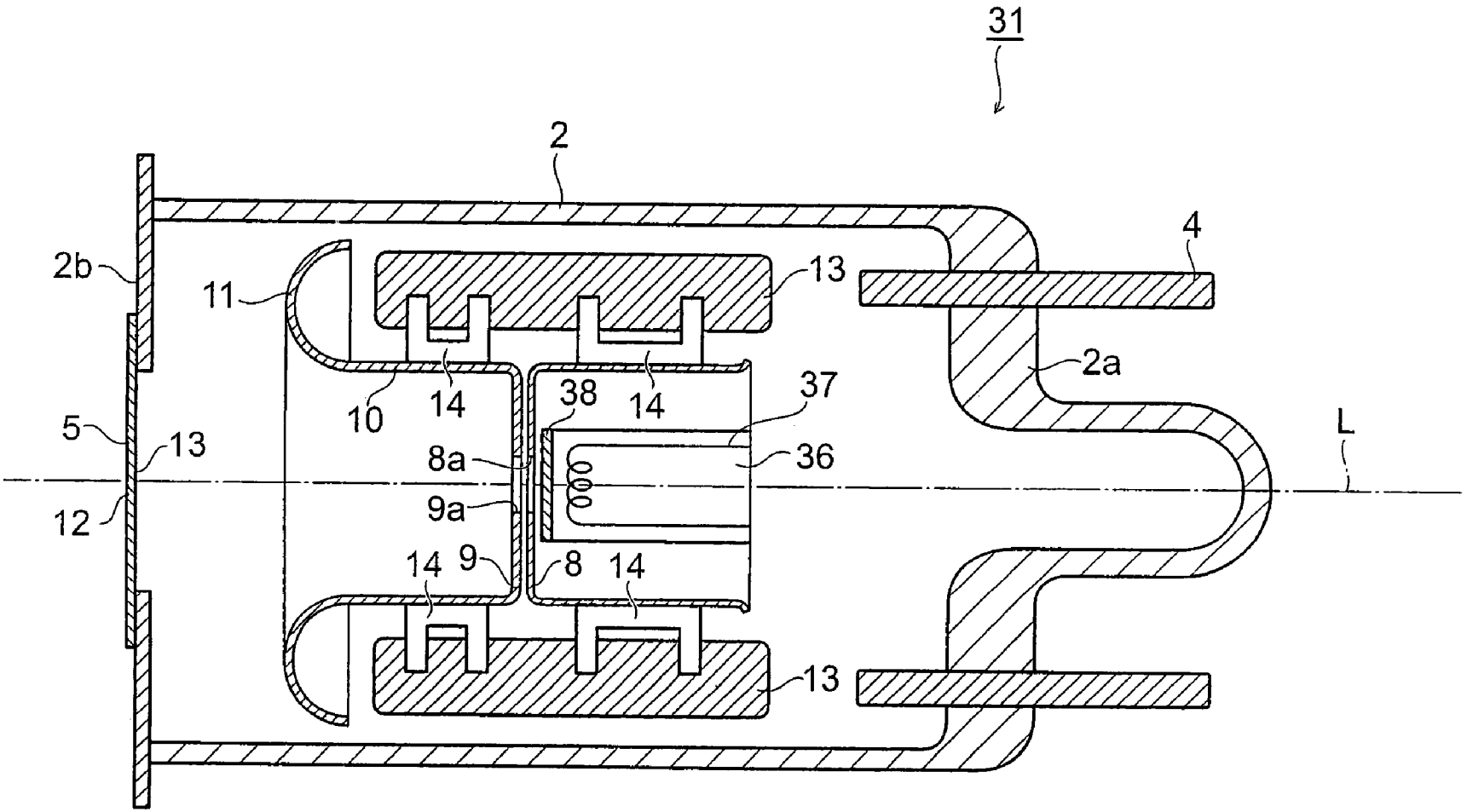
FIG. 4 is a view showing a cross-sectional structure of a modified example of the X-ray tube according to the present invention.

The present invention is not restricted to the above-described embodiment. For example, a hot cathode may be applied as the electron gun portion 3 that is the electron source. FIG. 4 is a view showing a cross-sectional structure of a modified example of an X-ray tube according to the present invention. In the X-ray tube 31 shown in FIG. 4, a hot cathode 36 is disposed at a center of an inner portion of the first electrode 8. In the hot cathode 36, a heater 37 that generates heat upon being supplied with electricity from the exterior is incorporated, and on an end face of the hot cathode 36 that faces the aperture 8*a* is formed a cathode 38 from which electrons are emitted by the heat generated from the heater 37. Even in this X-ray tube 31, the charging of the electrode supports 17 by reflected electrons, which, among the electrons made incident on the target 13 from the hot cathode 36, are reflected at the target 13, is prevented.

The X-ray tube according to the present invention is not restricted to a transmitting type of X-ray tube such as those described above and may be a reflecting type of X-ray tube.

Figure 5A:
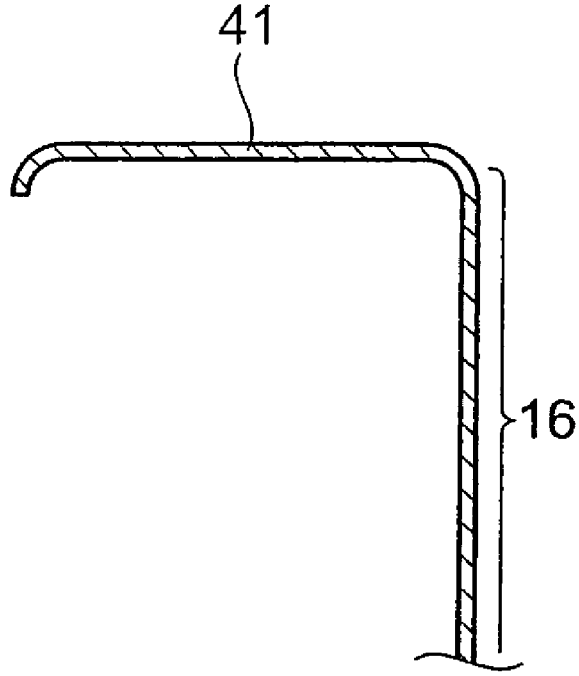
FIG. 5A and FIG. 5B are views showing cross-sectional structures of modified examples of a principal portion, especially an eave portion, shown in FIG. 2.
Figure 5B:
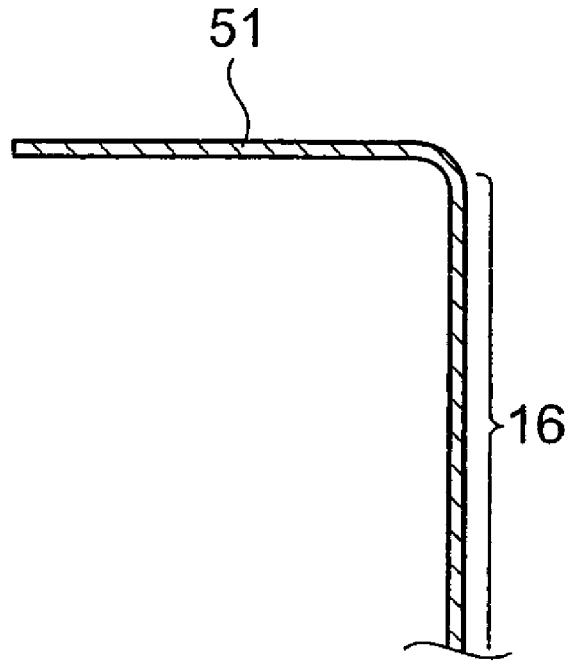

Also, various shapes may be employed as the shape of the eave portion of the second electrode 9. FIG. 5A and FIG. 5B are views showing cross-sectional structures of modified examples of the eave portion. As with an eave portion 41 shown in FIG. 5A, portions of the eave portion besides the front end and the portion near the end of the cylindrical portion 10 may be flat. Or, as with an eave portion 51 shown in FIG. 5B, the eave portion may have a shape with which a curvature is provided only near the end of the cylindrical portion 10 and the other portions extend rectilinearly in the radial direction of the second electrode 9. In any of these shapes, by providing the eave portion with curvature, the voltage resistance characteristics between the second electrode 9 and the target are improved. In regard to the point that the greater the curvature, the more improved are the voltage resistance characteristics with respect to the target, the shape of the eave portion 11 is preferable among the above-described eave portion shapes.

As described above, in accordance with the X-ray tube according to the present invention, the charging of insulating members, disposed inside a container, is effectively prevented to enable stable operation of the X-ray tube to be secured adequately even when the X-ray tube is made compact.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An X-ray tube comprising:

an insulating container having a side portion extending along a predetermined tube axis;

an electron source disposed on the tube axis and being accommodated in said container, said electron source emitting electrons;

a target disposed on the tube axis and being accommodated in said container, said target generating X-rays in response to the incidence of the electrons emitted from said electron source;

electrodes disposed between said electron source and said target and being accommodated in said container, each of said electrodes having a side face portion that extends along the propagation direction of the electrons propagating from said electrode source to said target and forming a predetermined electric field between said electron source and said target; and an insulating support member disposed along the respective side face portions of said electrodes and being accommodated in said container, said insulating support member supporting said electrodes, wherein said insulating support member is separated from said side portion of said insulating container by a predetermined distance, and wherein an endmost electrode positioned closest to said target, of said electrodes, has an anti-charging edge portion that is positioned at a target side end of the side face portion thereof and that extends in a direction orthogonal to the tube axis so as to cover over a target side end of said support member from said target.

2. An X-ray tube according to claim 1, wherein the anti-charging edge portion has a shape such that a front end portion thereof, opposing an end portion connected to the side face portion of said endmost electrode, extends further toward said support members.

3. An X-ray tube according to claim 1, wherein the anti-charging edge portion has a curved surface that is bent so as to protrude toward said target.

4. An X-ray tube according to claim 1, wherein an endmost electrode positioned closest to said target, of said electrodes, includes a focusing electrode that focuses that electrons, emitted from said electron source, toward said target.

5. An X-ray tube according to claim 1, wherein said electron source includes a field emission type of electron source.

* * * * *